United States Patent [19]

Bower

[11] Patent Number: 4,564,047

[45] Date of Patent: Jan. 14, 1986

[54] CONTROL VALVE

[75] Inventor: Lewis R. B. Bower, Wakefield, United Kingdom

[73] Assignee: Fletcher Sutcliffe Wild Limited, Wakefield, England

[21] Appl. No.: 593,807

[22] Filed: Mar. 27, 1984

[51] Int. Cl.[4] ..... E03B 3/00

[52] U.S. Cl. ..... 137/627.5; 91/461; 405/302

[58] Field of Search ..... 91/461; 405/302; 137/596.14, 596.18, 625.5, 884; 251/83; 299/31; 200/5 R, 5 A, 18, 50 C

[56] References Cited

U.S. PATENT DOCUMENTS

| | | | |
|---|---|---|---|
| 424,718 | 4/1890 | Miller et al. | 137/596.14 |
| 500,645 | 7/1893 | West | 251/83 |
| 2,293,226 | 8/1942 | Thornhill | 91/461 |
| 2,341,696 | 2/1944 | Davis | 91/461 |
| 2,745,628 | 5/1956 | Carlson | 251/83 |
| 2,812,218 | 11/1957 | Fitch et al. | 137/627.5 |
| 2,841,659 | 7/1958 | Eitel | 200/5 R |
| 3,487,853 | 1/1970 | Kern | 137/884 |
| 3,788,344 | 1/1974 | Dyck | 137/884 |
| 4,221,238 | 9/1980 | Madsen | 137/627.5 |
| 4,327,628 | 5/1982 | Weirich et al. | 405/302 |

FOREIGN PATENT DOCUMENTS

| | | | |
|---|---|---|---|
| 888477 | 12/1971 | Canada | 405/302 |
| 1300748 | 8/1969 | Fed. Rep. of Germany | 137/627.5 |
| 2749312 | 5/1979 | Fed. Rep. of Germany | 405/302 |
| 724768 | 3/1980 | U.S.S.R. | 405/302 |

*Primary Examiner*—James C. Yeung
*Assistant Examiner*—Noah Kamen
*Attorney, Agent, or Firm*—Trexler, Bushnell & Wolters, Ltd.

[57] ABSTRACT

A control valve arrangement includes at least one first supply and exhaust valve, and a second supply and exhaust valve. The first and second valves are arranged in series and are manually operated with a single hand. The first valve is manually displaced in one direction, and the second valve is displaced in the opposite direction.

15 Claims, 7 Drawing Figures

CONTROL VALVE

BACKGROUND OF THE INVENTION

This invention relates to a control valve for hydraulic fluid. The control valve may be for directly controlling a hydraulic device (e.g. a piston and cylinder unit) or for indirectly controlling a hydraulic device, and hence functioning as a so called command control valve, by controlling flow of hydraulic fluid in a pilot hydraulic circuit which in turn effects operation of a main valve controlling a main hydraulic circuit connected to the hydraulic device.

Such control valves—for direct or indirect control—are used extensively for instance in hydraulically powered, self-advancing mine roof supports, which are located side-by-side along the goaf side of an armoured, scraper chain conveyor extending along a mineral face, the conveyor being built up to its desired length by a plurality of line pans of unit length, secured together end-to-end, in articulated manner.

A commonly employed command control valve is of a rotary kind. However, after the manual actuation of a rotary command control valve, by the operator rotating the hand lever to achieve the mode of operation required e.g. retraction of a roof beam from the mine roof, extension of the advancing ram(s), retraction of the advancing ram(s), or setting of the roof beam against the mine roof, it is necessary for the operator to remember to rotate the hand lever to a neutral position, if the valve is to be made ineffective. Understandably, return of the hand lever to its neutral position cannot be guaranteed and on occasion movement of hydraulic hoses, falling of debris etc., has inadvertently actuated a rotary command control valve, with consequent operation of the main valve and hence unexpected movement of the mine roof support(s) in question, which is usually extremely hazardous to any personnel in the vicinity. Furthermore, a rotary valve can only be made to effect one command at any one time. For direct control of a mine roof support, the valve is used for the so called "in-chock" operations, such as advancing or retracting a face sprag mechanism and/or a forepoling beam (as are commonly provided on roof supports) of the roof support in which the valve is located.

SUMMARY OF THE INVENTION

According to the present invention, there is provided a control valve particularly for effecting control of a hydraulic circuit comprising:

at least one valve arrangement located in a first valve body which is provided with a hydraulic fluid supply port, a hydraulic fluid exhaust port, and a hydraulic fluid delivery port, the valve arrangement normally being biassed to a position in which fluid flow connection is made between the delivery port and the exhaust port, and the supply port is closed; and the valve arrangement being manually displaceable in a first direction, to cause firstly closure of the connection between the delivery port and the exhaust port and secondly, upon further displacement, opening of a fluid flow connection between the delivery port and the supply port; and a valve arrangement located in a second valve body which is provided with an inlet port connectable to a source of hydraulic fluid, a hydraulic fluid exhaust port, and a hydraulic fluid delivery port to deliver fluid to the supply port of the or each first valve body, the valve arrangement normally being biassed to a position in which fluid flow connection is made between the delivery port and the exhaust port, and the inlet port is closed, and manually displaceable in a second direction, which is opposite to said first direction, to cause firstly closure of the connection between the delivery port and the exhaust port, and secondly, upon further displacement, opening a fluid flow connection between the inlet port and the delivery port, to make fluid available to the supply port of the or each first valve body, whereby a hydraulic pressure is only transmitted from the control valve when there is activated not only the first valve body, or a selected one or more of the first valve bodies but also the second valve body.

Thus, the control valve in accordance with the invention does not require the operator to remember to put the valve into a safe, neutral mode after actuation, for the activated first valve body or bodies and/or second valve body automatically achieve(s) this upon being released from the manual displacement effected by the operator, due to this biassing, and furthermore, by either a first or the second valve body automatically achieving this neutral mode, the valve is doubly protected. Thus, even if a first valve body is activated, then unless the second valve body is also activated whilst the first valve body is still being activated, no pressure fluid is made available to the fluid supply port of the first valve body. Thus, whilst it is conceivable that movement of hydraulic hoses, falling of debris etc. might inadvertently activate the first valve body or bodies, or the second valve body, it is highly improbable that hoses or debris could activate both the first valve body or bodies and the second valve body simultaneously and in opposite directions, for as indicated above activation of both, and in opposite directions, is necessary in order to neutralise the double connection to exhaust before delivery of hydraulic pressure can be effected.

The valve arrangement of the or each first valve body may be manually displaceable via an individual piano key type, "function" lever, which conveniently depend(s) downwardly from the valve body, while the valve arrangement of the second valve body may be manually displaceable via a lever or bar of length approximately to that of the control valve, and also downwardly depending if the function lever(s) of first valve body or bodies is or are so arranged. Although the first valve body or bodies and the second valve body may form part of a common valve block, preferably, the or each first valve body, and the second valve body, are each constituted by a standard, self-contained valve body to provide a modular construction, the required number of valve body modules being assembled together on a manifold, to constitute a multi-module valve body, the the second valve body module being mounted in the reverse direction to the module(s) of the first valve body or bodies. Similarly, the manifold itself may be a one piece element, or alternatively each valve body module may be attached to its own manifold module to form a valve/manifold unit, the required number of units being sandwiched together to provide a control valve having the required number of functions. With either a one piece manifold or modular manifold, delivery of fluid from the delivery port of the second valve member is into a port extending along the manifold and connectable to the supply port of the supply port of the or each first valve body module. In detail, the modules of the valve body or manifold may be bolted together, with interposed gaskets. Conveniently, biassing of the valve arrangements is by spring means.

In principle, the control valve may incorporate any number of first valve body modules, say six or eight, (and hence six or eight piano key type function levers) mounted in a first direction and a single, second valve body module, mounted in the reverse direction. Thus, the embodiment with six first valve modules would—in the case of controlling hydraulically powered, self-advancing mine roof supports—function as a command control valve, would be located in a first roof support, and would control pilot circuits in turn controlling a main control valve in roof supports adjacent each side of the one in which the command control valve is was located, and would thus provide the so called "adjacent control" whereby the operator, from the safety of a support set to the roof, in which the particular command control valve is located, is able to control three functions of a selected adjacent support, by actuation of a selected set of three function levers, the functions being (1) the retraction (from the mine roof) of the roof support, (2) the advance of the roof support, and (3) the re-setting of the roof support (to the mine roof).

In certain circumstances, particularly when the control valve is functioning as a command control valve, it is desireable to maintain pilot pressure in the pilot circuit after release of the selected function lever and/or the lever or bar of the second valve body, such a circumstance being where the conventionally provided advancing ram of the roof support is required to advance a line pan of the conveyor to which it is mechanically connected. Therefore, in accordance with a modified version of the embodiment of the invention comprising a plurality of modules and a manifold, a pressure retaining block, incorporating a valve, is interposed between the modules and the manifold, the block incorporating a spring-loaded, mechanically displaceable valve member, together with an actuator having a nose projecting from the block and adapted to engage an extension of a function lever. This arrangement may provide for manual cancellation of the locked-in pilot pressure signal, by manually returning the actuator lever to its non-active position, whereby the function lever extension displaces the actuator nose, the latter unseating the valve member to release the locked-in pilot pressure signal, or alternatively it may be arranged for automatic cancellation of the locked-in pilot pressure signal to be effected upon advance of the support.

Furthermore, with piano key type levers, it is quite possible for the operator to actuate more than one of these simultaneously, together with the lever or bar of the second valve body and hence to achieve output from the command control valve of multiple pilo pressure signals.

DESCRIPTION OF THE DRAWINGS

The invention will now be described in greater detail, by way of example with reference to the accompanying drawing, in which.

DETAILED DESCRIPTION

Figure 6:
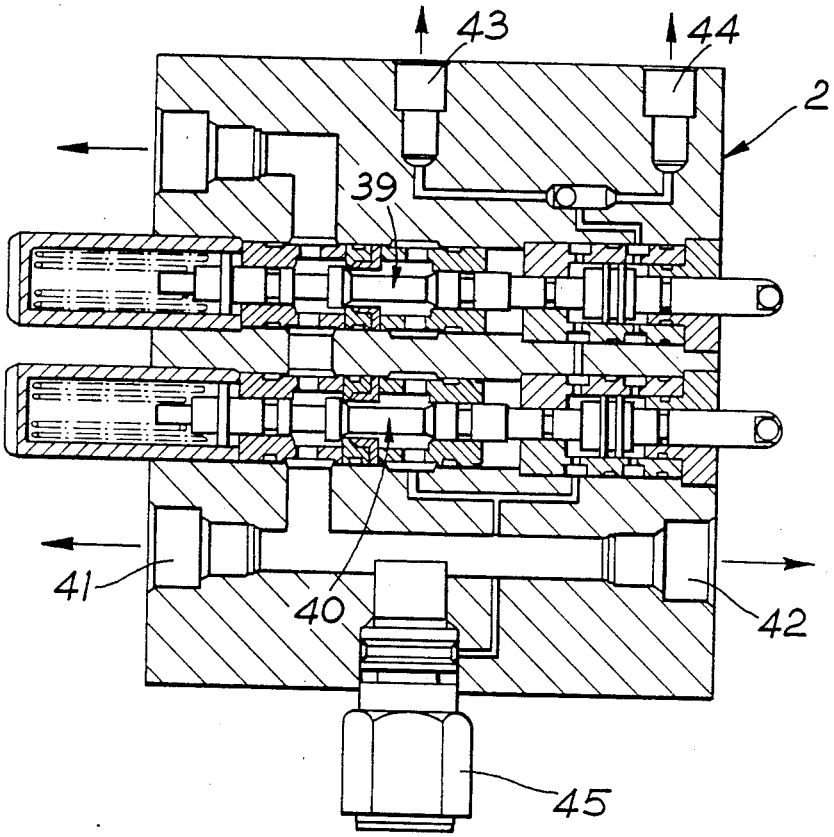
FIG. 6 is a sectional view through a known main control valve assembly controlled by pilot pressure signals from the command control valve of FIGS. 1 to 5.
Figure 7:
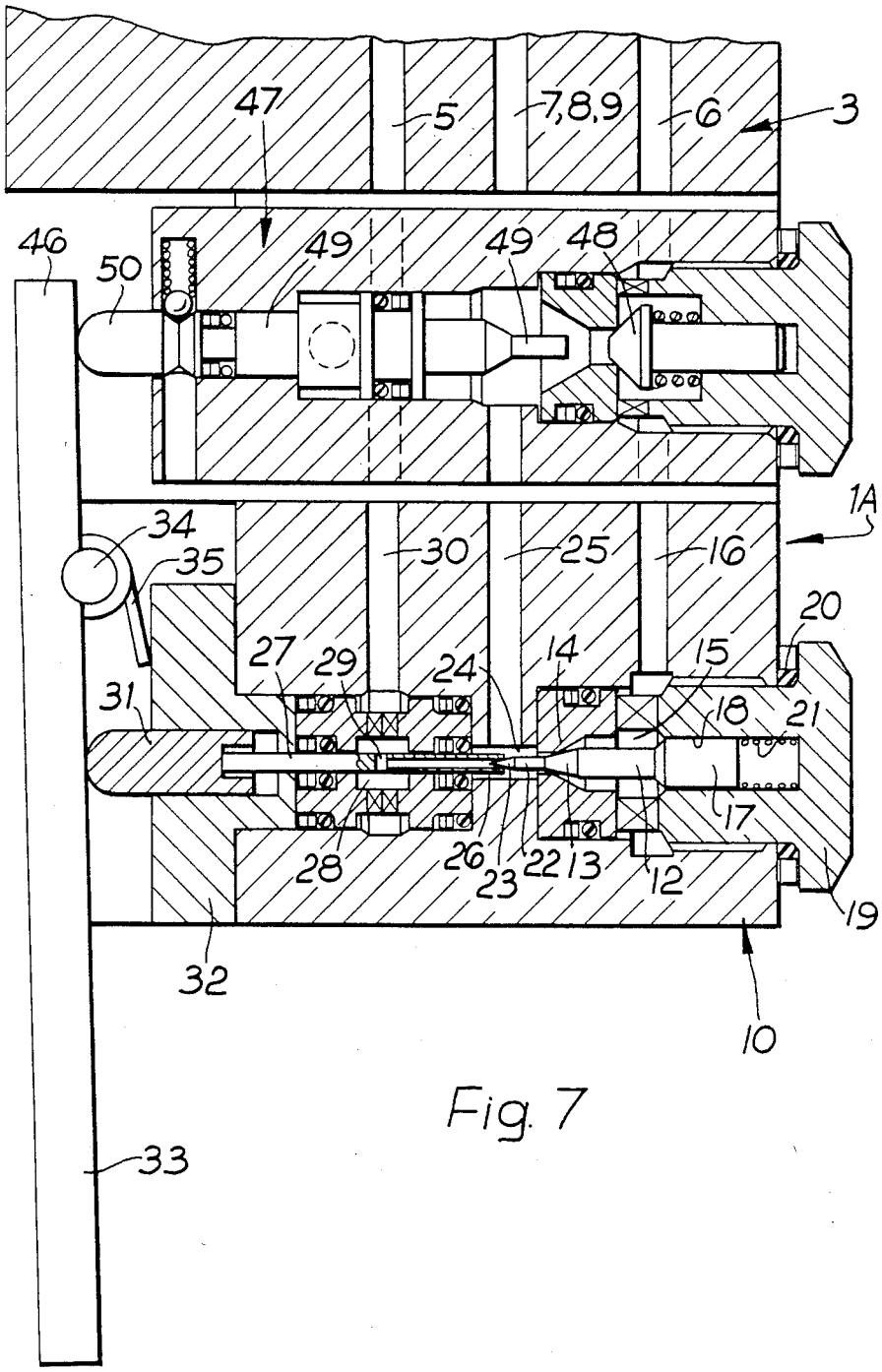
FIG. 7 is a sectional view through a second embodiment of control valve in accordance with the invention showing the valve member in a partially activated position.

Both the example of command control valve 1 illustrated in FIGS. 1 to 5 of the drawings and the example of control valve 1A illustrated in FIG. 7 of the drawings, are for installation in a mine roof support of the well known hydraulically powered, self-advancing kind. A plurality of such supports are located, in the well known manner, side-by-side along the goaf side of an armoured, scraper chain conveyor extending along the mineral face, the roof supports serving not only for their prime, roof supporting function, but also for advancing the individual, unit length line pans from which the conveyor is built up. The command control valve 1 in accordance with FIGS. 1 to 5 is intended for actuating, by pilot pressure signals, valve members of a main control valve assembly 2 exemplified in FIG. 6. A main control valve 2 assembly is likewise associated with each roof support and is connected to a mains pressure line, and a mains exhaust line, for activating the various hydraulic components, e.g. rams, chock legs etc., conventionally provided on a hydraulically powered mine roof support.

The example of command control valve 1 illustrated in FIGS. 1 to 5 of the drawings is intended for controlling, via the associated main control valve assembly 2, three functions of a roof support viz. "lower" (from the mine roof), "advance" (of the roof support towards a previously advanced line pan), and "re-set" (against the mine roof), and consequently the command control valve 1 comprises a one piece manifold block 3 provided, inter alia, with a fluid supply bore 4 connectable to a hydraulic pressure line (not shown) from a hydraulic pump, and an exhaust bore 5 connectable to a hydraulic exhaust line (not shown), a pilot pressure supply bore 6, an "advance" bore 7, a "lower" bore 8, and a "re-set" bore 9. The manifold block 3 carries six first valve body modules 10 each housing a first valve arrangement (to be described in detail later), and one second valve body module 11, identical to the modules 10 but disposed in the reverse direction to the valve modules 10, and housing a second valve arrangement (to be described in detail later), the valve modules 10 and 11 being bolted together, and to the manifold block 3, with interposed gaskets.

The command control valve 1 incorporates as many first modules 10 as are required for actuating the functions—three in the example illustrated—to be controlled by a main valve assemblies 2 which the command control valve 1 is hydraulically connected, with one set of three modules 10 being for controlling the function of an adjacent support located to one side of that support in which the command control valve 1 is located, and the other set of three modules 10 being for controlling the functions of the adjacent support to the other side.

With each module 10, the valve arrangement, comprises a valve spindle 12, having a first valve member 13 associated with a first valve seat 14 of a first valve chamber 15 in communication via a hydraulic fluid supply port 16 with the pilot pressure supply bore 6. The valve spindle 12 has an enlarged head 17 slidably located in an elongate aperture 18 extending coaxially with the longitudinal axis of the valve spindle 12 and provided in a closure plug 19 screwed into the module 10 with appropriate fluid seals 20 to close one end of the valve chamber 15. Also located in the aperture 18, between a closed end thereof, and the opposite face of the enlarged head 17, is a coil compression spring 21 by which the valve member 13 is normally biassed into engagement with its seat 14. Beyond the first valve member 13, the valve spindle 12 incorporates a reduced diameter portion 22 which terminates in a second, conical valve member 23 in a second valve chamber 24 which is in communication via a hydraulic fluid delivery port 25 with either one of bores 7, 8 or 9, and in FIG. 5, the delivery port 25 is illustrated as in communication with the "advance" bore 7. It follows that while ever the first valve member 13 is in engagement with its valve seat 14, no pilot pressure from bore 6, via port 16, the first valve chamber 15, the second valve chamber 24 and port 25 is available to achieve the selected function e.g. to provide a pilot pressure signal to the "advance" bore 7. Also located within the second valve chamber 24 is a second valve seat 26 provided at one end of a rod 27, the latter extending into a third valve chamber 28, and being hollow from the second valve seat 26 as far as a cross bore 29 in communication with the third valve chamber 28. The third valve chamber 28 is in communication via a hydraulic fluid exhaust port 30 with the exhaust bore 5. Hence in the non-activated valve position illustrated in FIG. 5, a fluid flow connection is made between the "advance" bore 7 and the "exhaust" bore 5 via the delivery port 25, the second valve chamber 24, the third valve chamber 28 and the exhaust port 30. The end of the rod 27 remote from the valve seat 26 is connected to a plunger 31 slidably housed within a plug 32, which also serves to close the third valve chamber 28, one end of the plunger 31 projecting from the plug 32. In the case of the modules 10, the plunger 31 is displaceable by a piano key type, "function" lever 33, pivotally attached to the module on a pivot pin 34, and urged away from its module by a wire spring 35. The function lever 33 also carries a legend plate 36 identifying the function associated with that module, while in the case of the module 11, there is provided a similar operating lever 37 which carries a longitudinal bar 38 approximating in length to that of the valve 1.

Figure 1:
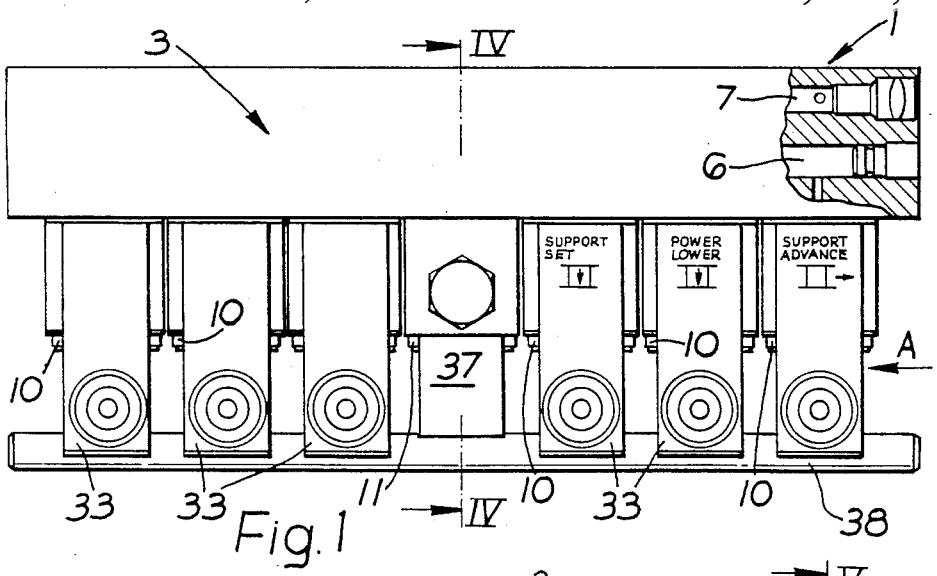
FIG. 1 is a front elevation of a control valve, of the command type, in accordance with the present invention.
Figure 2:
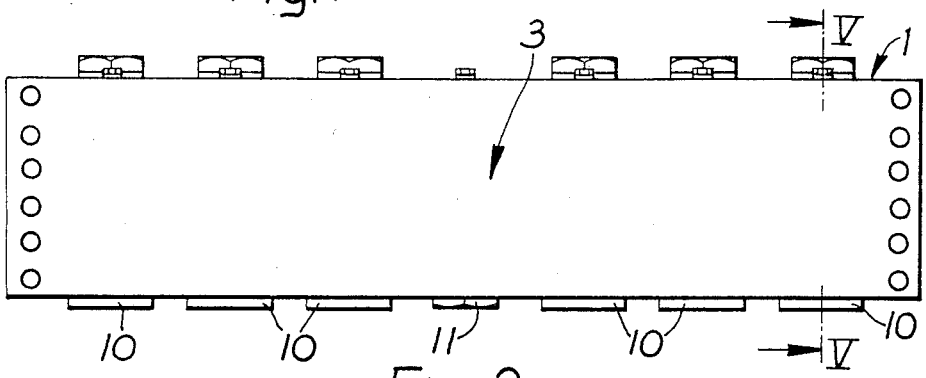
FIG. 2 is a plan view of FIG. 1.
Figure 3:
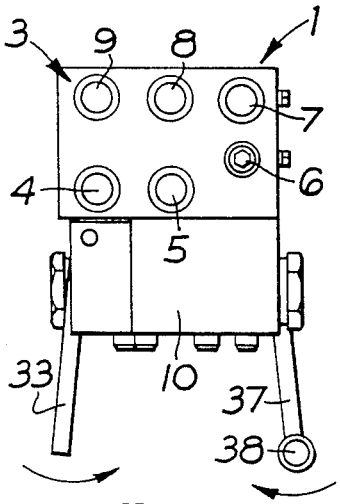
FIG. 3 is an end elevation of FIG. 1 in the direction of arrow A.
Figure 4:
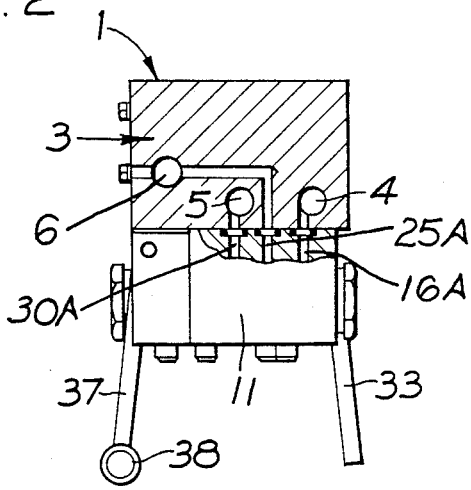
FIG. 4 is a section on the line IV—IV of FIG. 1.
Figure 5:
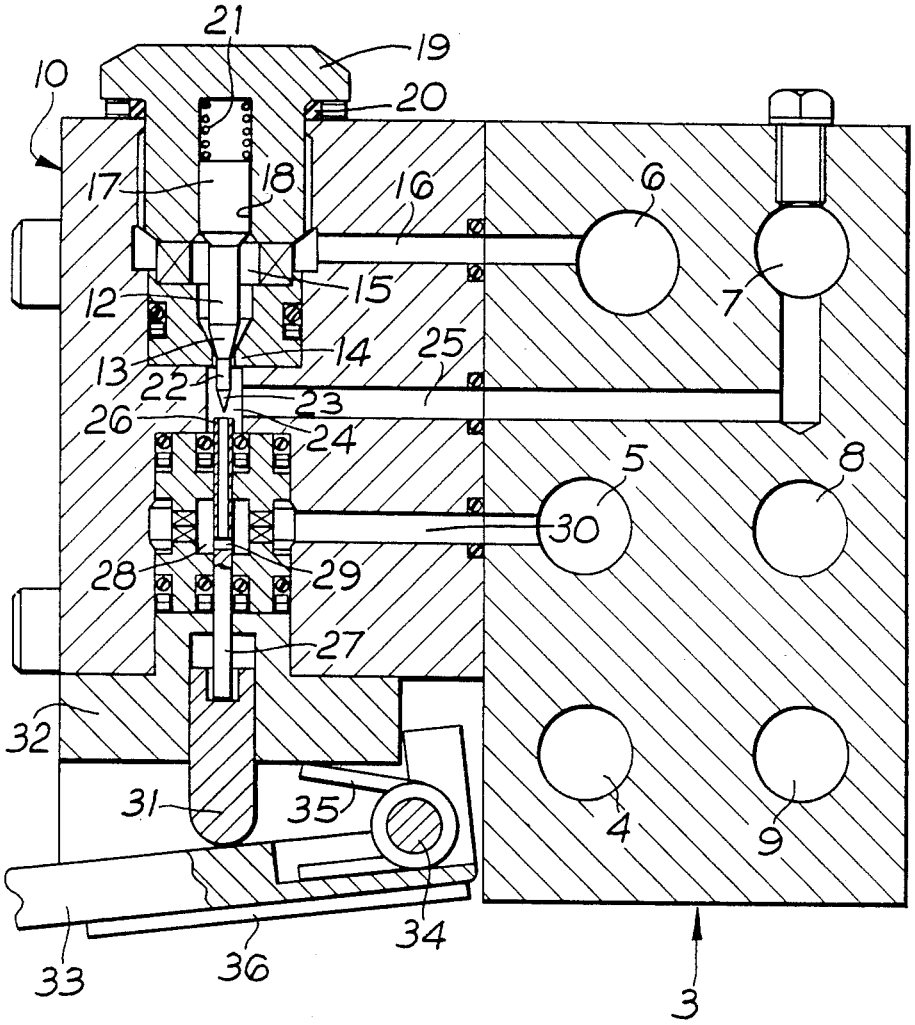
FIG. 5 is a section on the line V—V of FIG. 2 showing the valve member in a non-activated position.

The module 11 is identical to the modules 10, but is mounted on the manifold 3 is a reverse direction, the module 11, as indicated in FIG. 4, having an inlet port 16A connected to the fluid supply bore 4, a delivery port 25A connected to the pilot pressure supply bore 6, and an exhaust port 30A connected to exhaust bore 5. Thus with pressure fluid supplied to the bore 4 of the manifold 3, pressure fluid cannot progress beyond the module 11 until the latter is activated. Thus, to provide hydraulic pressure to the pilot delivery bore 6, from the supply bore 4 via the module 11, the pilot delivery bore 6 being common to all fluid support ports 16 of the six modules 10, one of the six function levers 33 is depressed, but no pressure can be generated until the bar 38 is depressed, to actuate the module 11, to achieve again closure of the normally open connection of this module to its exhaust port and subsequent fluid connection between bore 4 and pilot delivery bore 6. It follows that upon release of either the selected function lever 33 or the bar 38, the module returns to a neutral position, with no pressure signal present in the pilot bore 6, because the latter is automatically connected to exhaust.

The known, main control valve assembly 2 illustrated in FIG. 6, requires no detailed description, but comprises basically spring loaded, hydraulically balanced, pilot pressure actuated, pressure and exhaust poppet valves 39 and 40 respectively. The valve assembly 2 further comprises a bore 41 connected to a left hand rear leg (of a three leg mine roof support), a bore 42 connected to a right hand rear leg, bore 43 connected to one of the left hand side set of three modules 10, a bore 44 connected to one of the right hand side set of three modules 10, and a yield valve 45.

The second embodiment of control valve 1A, which is illustrated in FIG. 7, would, if its presence were required for line pan advancing functions, be attached to one end of the valve 1 of FIGS. 1 to 5, with the manifold 3 thereof suitably extended. The control valve 1A incorporates a module 10 identical to that of FIGS. 1 to 5, but having an extension 46 on its function lever 33, while interposed between the module 10 and the manifold is a block 47 incorporating a spring loaded, check valve 48, which is mechanically displaceable against the action of its spring by a slidable actuator 49 having a nose 50 projecting from the block 47 and engaging the extension 46 of the function lever 33. Thus, after pressure delivery has been effected through port 25 and check valve 48 to pilot supply bore 6, pressure is held in the bore 6 by closure of the valve 48, after release of the function lever 33 and the bar 38, with pressure being released from the bore 6 by the check valve 48 becoming unseated, by displacement of the slidable actuator 49, either manually by operation of the function lever 33, whereby the extension 46 displaces the nose 49, or alternatively automatic release may be arranged, upon the support being advanced.

What I claim is:

1. A control valve particularly for effecting control of a hydraulic circuit comprising: at least one first valve means including a first valve body; a hydraulic fluid supply port, a hydraulic fluid exhaust port, and a hydraulic fluid delivery port provided in said first valve body; means for normally biasing said first valve means to a position for making fluid flow connection between said delivery port and said exhaust port, and for closing said supply port; and first manual control means for manually displacing said first valve means to a first extent in a first direction for causing closure of said connection between said delivery port and said exhaust port and to a further extent in said first direction for opening a fluid flow connection between said delivery port and said supply port; and second valve means including a second valve body; a second inlet port connectable to a source of hydraulic fluid, a second hydraulic fluid exhaust port, and a second hydraulic fluid delivery port provided in said second valve body, said second delivery port being connectable to said supply port of each said first valve body; means for normally biasing said second valve means to a position for making fluid flow connection between said second delivery port and said second exhaust port, and for closing said second inlet port; and second manual control means for manually displacing said second valve means to a first extent in a second direction which is opposite to said first direction for causing closure of said connection between said second delivery port and said second exhaust port, and to a further extent in said second direction for opening a fluid flow connection between said inlet port and said delivery port, to make fluid available to said supply port of each said first valve body; whereby a hydraulic pressure is only transmitted from said control valve when there is activated not only at least one said first manual control means of said first valve body, but also said second manual control means of said second valve body; wherein said first and second manual control means are located sufficiently closely to one another to be gripped by one hand of an operator for simultaneous operation.

2. A control valve as claimed in claim 1, wherein said valve arrangement of said first valve body(ies) is manually displaceable via an individual, piano key type, "function" lever.

3. A control valve as claimed in claim 2, wherein said function lever(s) depends downwardly from said valve body.

4. A control valve as claimed in claim 1, wherein said valve arrangement of said second valve body is manually displaceable via a lever or bar of length approximately to that of said control valve.

5. A control valve as claimed in claim 1, wherein a common valve block forms part of said first valve body(ies), and said second valve body.

6. A control valve as claimed in claim 1, wherein said first valve body, and said second valve body, are each located in a standard, self-contained valve body module.

7. A control valve as claimed in claim 6, comprising a manifold, a plurality of said first and second valve body modules assembled together on said manifold, with said second valve body module being mounted in the reverse direction to said first valve body module(s).

8. A control valve as claimed in claim 7, wherein said manifold is a one piece element.

9. A control valve as claimed in claim 7, wherein a pilot pressure supply port extends along said manifold and delivery of fluid from said delivery port of said second valve body is into said pilot pressure supply port the latter being in communication with said supply port(s) of said first valve body(ies).

10. A control valve as claimed in claim 6, incorporating six first valve modules.

11. A control valve as claimed in claim 7, comprising a plurality of said first and second valve body modules mounted on said manifold, a pressure retaining block, incorporating a valve, interposed between said valve body modules and said manifold, said block incorporating a spring-loaded, mechanically displaceable valve member, together with an actuator having a nose projecting from said block and adapted to engage an extension of a function lever.

12. A control valve as claimed in claim 1, wherein biassing of said valve arrangements is by spring means.

13. A control valve particularly for effecting control of a hydraulic circuit comprising: at least one first valve means including a first valve body; a hydraulic fuid supply port, a hydraulic fluid exhaust port, and a hydraulic fluid delivery port provided in said first valve body; means for normally biasing said first valve means to a position for making fluid flow connection between said delivery port and said exhaust port, and for closing said supply port; and first manual control means for manually displacing said first valve means to a first extent in a first direction for causing closure of said connection between said delivery port and said exhaust port and to a further extent in said first direction for opening a fluid flow connection between said delivery port and said supply port; and second valve means including a second valve body; a second inlet port connectable to a source of hydraulic fluid, a second hydraulic fluid exhaust port, and a second hydraulic fluid delivery port provided in said second valve body, said second delivery port being connectable to said supply port of each said first valve body; means for normally biasing said second valve means to a position for making fluid flow connection between said delivery port and said second exhaust port, and for closing said second inlet port; and second manual control means for manually displacing said second valve means to a first extent in a second direction which is opposite to said first direction for causing closure of said connection between said second delivery port and said second exhaust port, and to a further extent in said second direction for opening a fluid flow connection between said inlet port and said delivery port, to make fluid available to said supply port of each said first valve body; whereby a hydraulic pressure is only transmitted from said control valve when there is activated not only at least one first manual control means of said first valve body, but also said second manual control means of said second valve body; wherein said at least one first valve body, and also said second valve body, are each located in an individual and identical self-contained valve body module; and further comprising a manifold, a plurality of said first valve body modules and said second valve body module being assembled together on said manifold, with said second valve body module being mounted in the reverse direction to said first valve body modules; and a pressure retaining block, incorporating a valve, interposed between one of said first valve body modules and said manifold, said block incorporating a spring-loaded, mechanically displaceable valve member, together with an actuator having a nose projecting from said block and adapted to engage an extension of a function lever comprising one of said first manual control means.

14. A control valve particularly for effecting control of a hydraulic circuit comprising: a plurality of first valve means, each including a first valve body; a hydraulic fluid supply port, a hydraulic fluid exhaust port, and a hydraulic fluid delivery port provided in said first valve body; means for normally biasing each of said first valve means to a position for making fluid flow connection between said delivery port and said exhaust port, and for closing said supply port; and first manual control means associated with each first valve means for manually displacing its associated first valve means to a first extent in a first direction for causing closure of said connection between said delivery port and said exhaust port and to a further extent in said first direction for opening a fluid flow connection between said delivery port and said supply port; and a second valve means including a second valve body; a second inlet port connectable to a source of hydraulic fluid, a second hydraulic fluid exhaust port, and a second hydraulic fluid delivery port provided in said second valve body, said second delivery port being connectable to said supply port of each said first valve body; means for normally biasing said second valve means to a position for making fluid flow connection between said second delivery port and said second exhaust port, and for closing said second inlet port; and second manual control means for manually displacing said second valve means to a first extent in a second direction which is opposite to said first direction for causing closure of said connection between said second delivery port and said second exhaust port, and to a further extent in said second direction for opening a fluid flow connection between said inlet port and said delivery port, to make fluid available to said supply port of each of said first valve bodies; whereby a hydraulic pressure is only transmitted from said control valve when there is activated not only at least one said first manual control means of one said first valve body, but also said second manual control means of said second valve body; wherein at least one of said first manual control means and second manual control means are located sufficiently closely to one another to be gripped by one hand of an operator for simultaneous operation.

15. A control valve particularly for effecting control of a hydraulic circuit comprising: at least one first valve means including a first valve body; a hydraulic fluid supply port, a hydraulic fluid exhaust port, and a hydraulic fluid delivery port provided in said first valve body; means for normally biasing said first valve means to a position for making fluid flow connection between said delivery port and said exhaust port, and for closing said supply port; and first manually depressable control means for manually displacing said first valve means to a first extent in a first direction for causing closure of said connection between said delivery port and said exhaust port and to a further extent in said first direction for opening a fluid flow connection between said delivery port and said supply port; and second valve means including a second valve body; a second inlet port connectable to a source of hydraulic fluid, a second hydraulic fluid exhaust port, and a second hydraulic fluid delivery port provided in said second valve body, said second delivery port being connectable to said supply port of each said first valve body; means for normally biasing said second valve means to a position for making fluid flow connection between said second delivery port and said second exhaust port, and for closing said second inlet port; and second manually depressable control means for manually displacing said second valve means to a first extent in a second direction which is opposite to said first direction for causing closure of said connection between said second delivery port and said second exhaust port, and to a further extent in said second direction for opening a fluid flow connection between said inlet port and said delivery port, to make fluid available to said supply port of each said first valve body; whereby a hydraulic pressure is only transmitted from said control valve when there is activated not only at least one said first control means of said first valve body, but also said second control means of said second valve body; a manifold; said at least one first valve means and said second valve means being coupled to said manifold in reverse orientation so as to require depression of the respective manually depressable control means thereof in reverse, mutually inwardly facing directions; said manifold including a fluid inlet port coupled with a supply of pressurized fluid and coupled to the supply port of said second valve means, and a common fluid supply port coupled between the delivery port of said second valve means and the supply port of said at least one first valve means.

* * * * *